US011071333B2

(12) United States Patent
Priest

(10) Patent No.: US 11,071,333 B2
(45) Date of Patent: Jul. 27, 2021

(54) BACKPACK

(71) Applicant: M&M Sales Enterprises Inc., Dubuque, IA (US)

(72) Inventor: John Brian Priest, Dubuque, IA (US)

(73) Assignee: M&M Sales Enterprises Inc., Dubuque, IA (US)

( * ) Notice: Subject to any disclaimer, the term of this patent is extended or adjusted under 35 U.S.C. 154(b) by 329 days.

(21) Appl. No.: 15/823,555

(22) Filed: Nov. 27, 2017

(65) Prior Publication Data

US 2019/0159532 A1 May 30, 2019

(51) Int. Cl.

| | |
|---|---|
| ***A41D 13/01*** | (2006.01) |
| ***A45F 3/04*** | (2006.01) |
| ***A45C 15/06*** | (2006.01) |
| ***A45F 3/00*** | (2006.01) |

(52) U.S. Cl.

CPC ..... *A41D 13/01* (2013.01); *A45C 15/06* (2013.01); *A45F 3/04* (2013.01); *A45F 2003/003* (2013.01)

(58) Field of Classification Search

CPC ..... A41D 13/01; A45C 15/06; A45F 3/04
USPC ..... 224/153
See application file for complete search history.

(56) References Cited

U.S. PATENT DOCUMENTS 5,454,185 A * 10/1995 Love ..... A01K 97/06 43/57.1
5,911,348 A * 6/1999 Shook ..... A45F 3/04 224/153
5,979,722 A * 11/1999 Gonzales ..... B62J 21/00 2/46
5,984,154 A * 11/1999 Scicluna ..... A45F 3/04 190/18 A
5,988,465 A * 11/1999 Vitale ..... A45C 15/00 224/153
6,120,162 A * 9/2000 Guerrieri ..... A45C 15/06 362/155
6,152,572 A * 11/2000 Cutler ..... A45C 15/06 362/155
6,227,424 B1 * 5/2001 Roegner ..... A45C 1/04 150/131
6,230,952 B1 * 5/2001 Jupiter ..... A45F 3/04 150/113
6,393,613 B1 * 5/2002 Sheu ..... A41D 15/04 2/94

(Continued)

FOREIGN PATENT DOCUMENTS

| | | | | |
|---|---|---|---|---|
| FR | 2980346 A3 * | 3/2013 | ..... | A45F 3/04 |
| GB | 2504296 A * | 1/2014 | ..... | A45F 3/042 |
| JP | 2003093131 A * | 4/2003 | | |

*Primary Examiner* — Nathan J Newhouse
*Assistant Examiner* — Lester L Vanterpool
(74) *Attorney, Agent, or Firm* — Rathe Lindenbaum LLP

(57) ABSTRACT

A backpack may include a first panel having a first panel surface facing in a direction and a second panel. The second panel has a second panel first surface and a second panel second surface opposite the second panel first surface. The second panel first surface is inconspicuous. The second panel is pivotable relative to the first panel between (1) a concealment position in which second panel second surface faces the first panel surface and (2) a safety position in which the second panel second surface faces in the. The backpack further includes a safety optic formed on one of the first panel surface and the second panel second surface.

18 Claims, 8 Drawing Sheets

(56) References Cited

U.S. PATENT DOCUMENTS

| | | | | |
|---|---|---|---|---|
| 6,870,089 | B1 * | 3/2005 | Gray | H01L 31/042 136/200 |
| 8,496,344 | B1 * | 7/2013 | Chapman | A45F 3/04 362/156 |
| 2002/0179653 | A1 * | 12/2002 | Klamm | A45F 3/04 224/153 |
| 2003/0179569 | A1 * | 9/2003 | Huang | A45C 13/08 362/109 |
| 2007/0062994 | A1 * | 3/2007 | Shoemaker | A41D 13/0012 224/576 |
| 2007/0295772 | A1 * | 12/2007 | Woodmansee | A45F 3/047 224/576 |
| 2008/0037242 | A1 * | 2/2008 | Long | A45C 15/06 362/156 |
| 2009/0314595 | A1 * | 12/2009 | Miller | A45C 13/42 190/111 |
| 2010/0116860 | A1 * | 5/2010 | Tello | A45F 3/04 224/576 |
| 2011/0163529 | A1 * | 7/2011 | Rossing | A45C 13/42 283/70 |
| 2011/0170282 | A1 * | 7/2011 | Munoz | A45C 15/06 362/156 |
| 2012/0312851 | A1 * | 12/2012 | Rico | A45C 1/04 224/576 |
| 2014/0166704 | A1 * | 6/2014 | Perera | A45F 3/04 224/153 |
| 2016/0128454 | A1 * | 5/2016 | Han | A45C 11/00 224/153 |
| 2017/0276457 | A1 * | 9/2017 | Chapman | A45F 3/04 |

* cited by examiner

BACKPACK

BACKGROUND

Backpacks comprise sacks or bags worn on one's back and secured with one or two straps to go over at least one shoulder. Backpacks may be referred to by various other names such as bookbag, kitbag, rucksack, pack, kitbag, sack pack or back sack. Backpacks are fluidly used by hikers, bicycle riders and students to reduce loads being hand carried or to free one's hands when carrying large loads over long distances.

Figure 2:
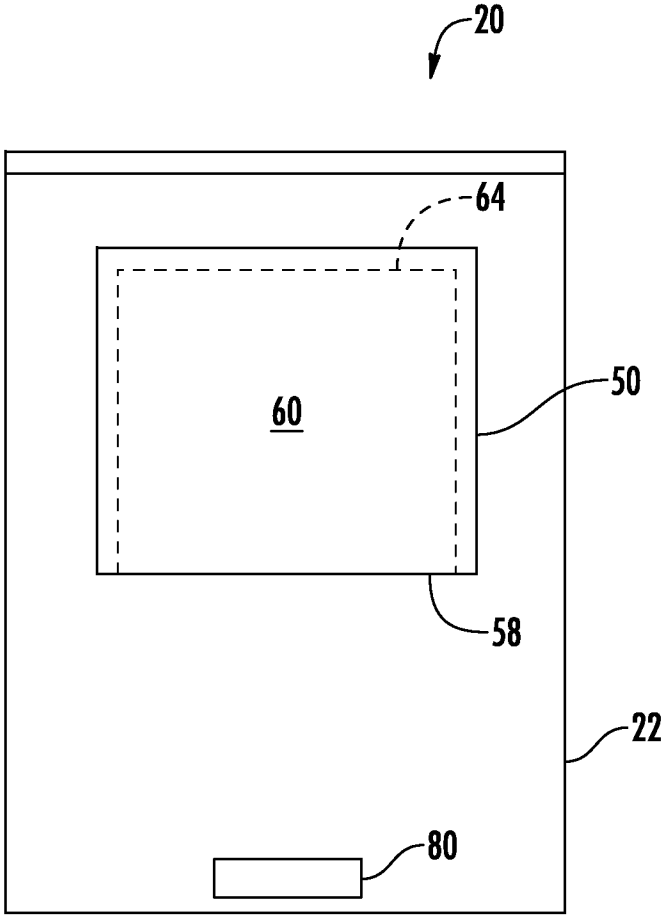
FIG. 2 is a rear view of the backpack of FIG. 1.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed herein are example backpacks that are selectively actuatable from a default inconspicuous state to a conspicuous safety state. The default inconspicuous state allows the backpack to be used without drawing attention to the person wearing the backpack. However, upon being actuated to the conspicuous safety state, the disclosed backpacks allow the person wearing the backpack to be conspicuously seen. When actuated to the conspicuous state, the backpacks provide safety by allowing a person wearing the backpack while traveling in dark or lowlight situations to be easily seen by trailing bicycles or vehicles. When actuated to the conspicuous state, the backpacks provide safety by allowing the person wearing the backpack to be more easily identified by hunters. When actuated to the conspicuous state, the backpacks provide safety by allowing a lost child wearing the backpack to be more easily seen and identified or singled out amongst a crowd.

The disclosed example backpacks utilize a backpack safety system that conceals a safety optic when the backpack or the backpack safety system is in the default inconspicuous state. The disclosed example backpacks have a panel that pivots to expose or actuate the safety optic, actuating the backpack or backpack safety system to the conspicuous safety state. The safety optic faces in a rearward direction, away from the person wearing the backpack such that those trailing the person wearing the backpack may quickly and easily identify the now conspicuous person.

In one implementation, the safety optic comprises a diffuse reflector. A diffuse reflector is a material or surface that reflects visible wavelength of light in a diffuse manner while absorbing less than 50% of the wavelengths of visible light. In some implementations, the diffuse reflector absorbs less than 5%, and nominally no wavelengths of visible light. A diffuse reflector may comprise material or surface that a light pigment, such as a material or surface having a white, gray, silver or tan color. In contrast to a dark color, such as black, brown or blue, the light pigment color reflects light from a trailing vehicle, allowing the person wearing the backpack to be more easily spotted and seen. In one implementation, the safety optic may comprise a diffuse reflector in the form of a shiny surface or a safety reflector in the form of an array of prisms or spheres, similar to those found in a bicycle reflector.

In one implementation, the safety optic may comprise a conspicuous color, a color that is more easily seen by the human eye as compared to other colors or the surrounding environment. Examples of the conspicuous color include yellow and orange. Blaze orange is an example of a conspicuous color.

In some implementations, the safety optic may be luminescent in that it emits light. For example, in one implementation, safety optic may be fluorescent in the presence of visible light such as a yellow, orange or pink color that is fluorescent. In one implementation, the safety optic may be formed from a glow-in-the-dark material. In one implementation, the safety optic may comprise a light emitter such as at least one light emitting diode or the light emission device. In such an implementation, the light emitter or light-emitting diode may actuate between and on and an off state in response to pivoting of the safety panel of the backpack.

In some implementations the safety optic that is exposed in response to pivoting of the safety panel comprises multiple optical safety elements. For example, in one implementation, pivoting of the safety panel on the rear face of the backpack may expose or make viewable to persons trailing the person wearing the backpack a safety optic that comprises a diffuse optical reflector, a conspicuous color, a fluorescent color and/or a light emitting diode.

In some implementations, pivoting of the safety panel further exposes an identification panel or tag. The identification panel may include information identifying the person wearing the backpack or information associated with the person wearing the backpack. For example, the identification panel may include address for a phone number for a parent or guardian of the child wearing the backpack. In the default inconspicuous state, safety panel conceals such personal information. However, in circumstances where a child is lost, pivoting of the panel allow the parent or guardian of the lost child to be identified.

In some implementations, the safety panel that is pivoted to actuate the backpack to a safety state forms a pocket, providing a dual-purpose. In some implementations, the safety panel is removably mounted to a rear face of the backpack, facilitating the upgrade of existing backpack to provide additional safety for the person wearing the backpack. In some implementations, the backpack or the backpack safety system which is mounted to a backpack may comprise an additional pivoting safety panel, wherein the two pivoting panels may be selectively pivoted to expose different safety optics or to expose different amounts of personal information regarding the person wearing the backpack. For example, in first lighting conditions or in a first environment, a first safety optic may be exposed by pivoting a first safety panel. In different second lighting conditions or in a different environment, a second different safety optic may be exposed by pivoting a second safety panel.

Figure 1:
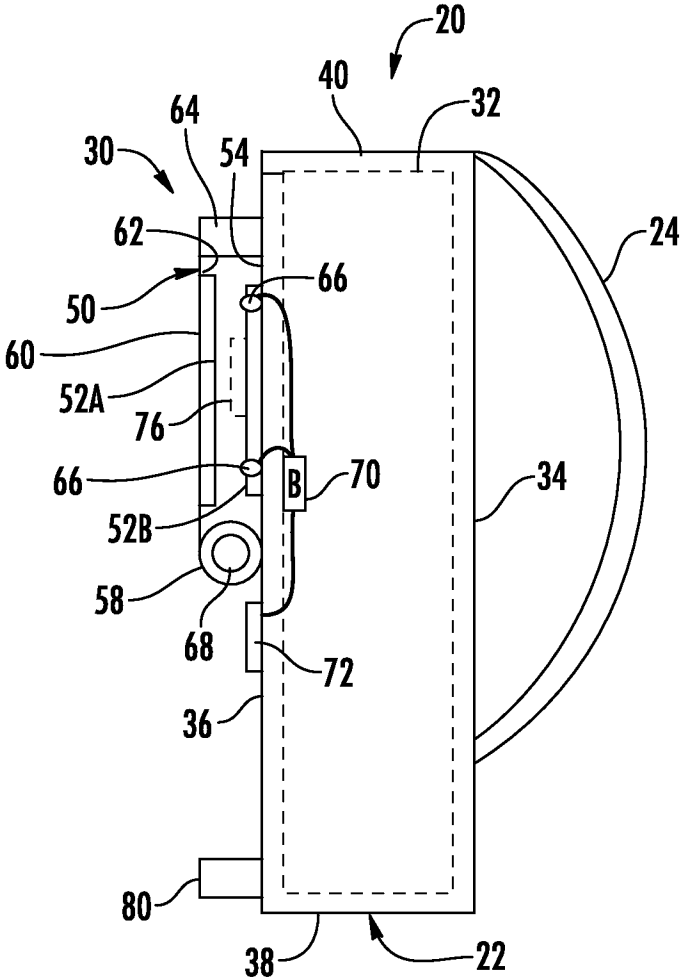
FIG. 1 is a sectional view schematically illustrating portions of an example backpack in an inconspicuous state.
Figure 4:
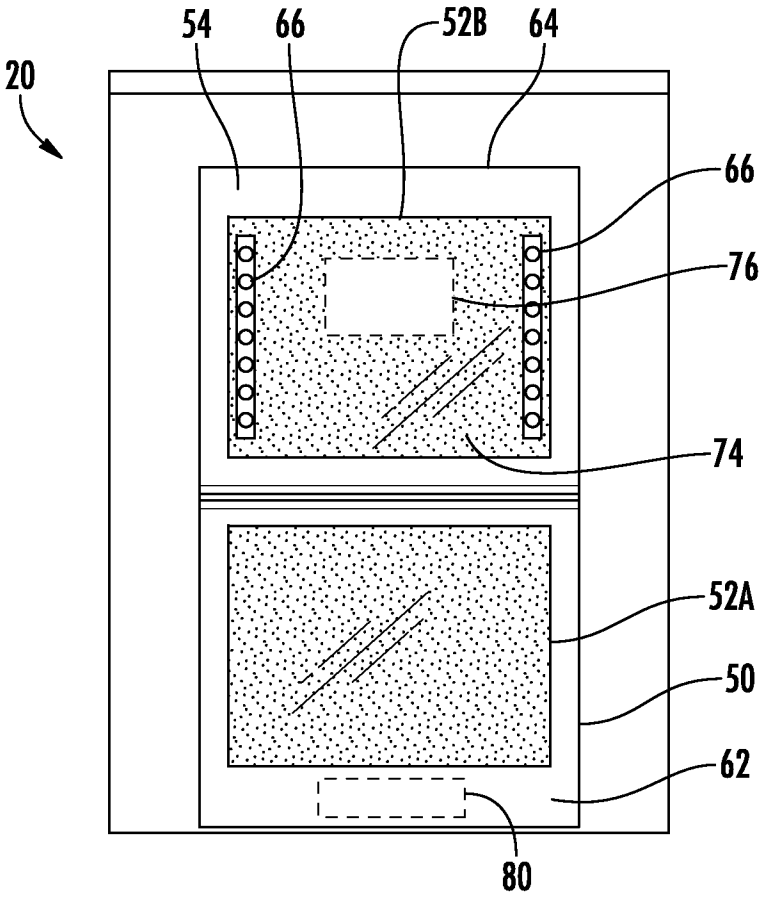
FIG. 4 is a rear view of the backpack of FIG. 3.
Figure 3:
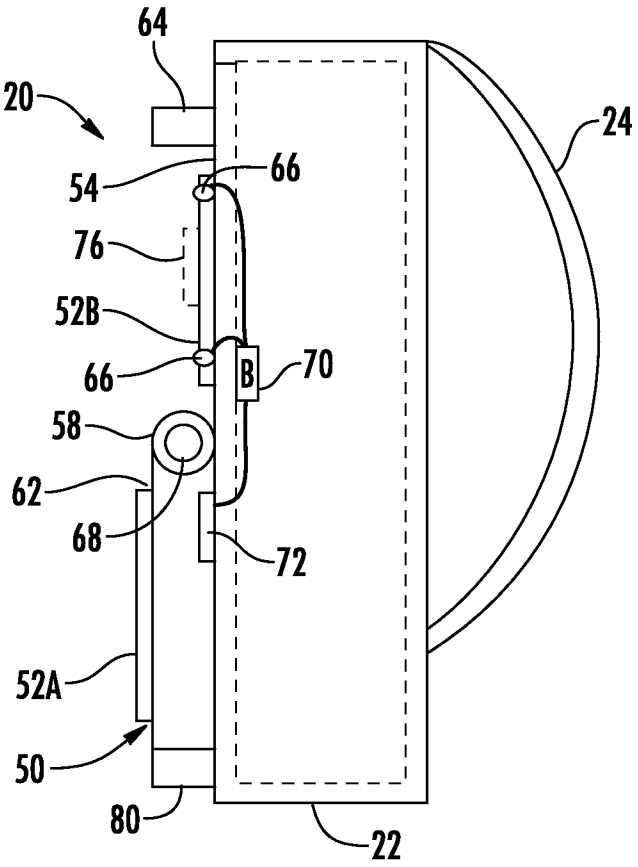
FIG. 3 is a sectional view schematically illustrating portions of the example backpack of FIG. 1 in a conspicuous safety state.

FIGS. 1-4 schematically illustrate portions of an example backpack 20 that is actuatable between an inconspicuous state and a conspicuous safety state. FIGS. 1 and 2 illustrate backpack 20 in the inconspicuous state while FIGS. 3 and 4 illustrate backpack 20 in the conspicuous safety state. FIGS. 1 and 3 are side sectional views of backpack 20 while FIGS. 2 and 4 are rear views of backpack 20; the front of backpack 22 facing the person wearing backpack 20. Backpack 20 comprises main body 22, shoulder straps 24 and backpack safety system 30.

Main body 22 comprises an arrangement of panels that form an interior compartment 32 (shown in broken lines). In some implementations, main body 22 forms multiple compartments 32. In one implementation, main body 22 comprises a front panel 34, a panel 36, a bottom panel 38 and a top panel, such as a cover panel 40. Panels 34, 36, 38 and 40 may be formed from fabric, vinyl, canvas or variety of different materials. Panels 34, 36, 38 and 40 may be sown or stitched to one another so as to form compartment 32.

In one implementation, the interior of compartment 32 is accessible through a top opening in body 22, wherein the top opening is covered by an overlapping cover panel. In one implementation, the interior of compartment 32 is accessible through an opening which is close by a drawstring extending about a mouth of the opening. In another implementation, the interior of compartment 32 is accessible through a zippered opening extending along a first side of body 22, across top panel 40 and down a second opposite side of body 22. The size of compartment 32 of the number compartments may vary depending upon the particular use of backpack 20, whether as a school backpack, a day pack or a hiking/camping backpack.

Shoulder straps 24 extend from body 22 along front panel 34. Shoulder straps 24 have a length so as to wrap about the shoulders of a person wearing backpack 20. In one implementation, shoulder straps 24 each have an adjustable length. In some implementations, backpack 20 may omit one of shoulder straps 24. In some implementations, backpack 20 may additionally comprise a hip belt or waist harness (not shown) projecting the sides and/or front panel 34, the hip belt to wrap about the waste and hips of a person wearing backpack 20.

Backpack safety system 30 converts backpack 20 to a conspicuous safety state such that the person wearing backpack 20 may be more easily seen and/or identified. System 30 comprises rear panel 36, safety panel 50 and safety optics 52A, 52B (collectively referred to as safety optics 52). Rear panel 36 comprises a panel having a rearwardly facing panel surface 54. Surface 54 faces away from the person wearing backpack 20. In the example illustrated, rear panel 36 forms a part of or defines compartment 32. In the example illustrated rear panel 36 is integrally formed as a single unitary body as part of body 22, inseparable from pack 20.

Safety panel 50 is pivotably coupled to rear panel 36 for pivotal movement between a concealment position shown in FIGS. 1 and 2 and a safety position shown in FIGS. 3 and 4. In the example illustrated, safety panel 50 is pivotably coupled to rear panel 36 for pivotal movement about a hinge 58 (schematically illustrated and enlarged or exaggerated for purposes of illustration). In one implementation, hinge 58 may comprise a living hinge, a hinge formed by the flexibility and bendability of the material adjacent a juncture of the end portion of panel 50 and panel 36. For example, in one implementation, panel 50 may be formed from a flexible fabric material stitched, welded or adhered to rear panel 36, wherein the flexible fabric material is bendable, allowing panel 50 to bend or pivot to the position shown in FIGS. 3 and 4. In one implementation, panel 50 may be coupled to rear panel 36, wherein panel 50 is pivotable about a fold or series of perforations within or through portions of panel 50.

As shown by FIG. 1, panel 50 has an exterior rearwardly facing first surface 60 and an interior second forward facing surface 62. In the example illustrated, surface 60 is inconspicuous does not include safety optics 52. In the concealment position shown in FIGS. 1 and 2, surface 60 faces in the same direction as panel surface 54 of rear panel 36. In one implementation, surface 60 has a same appearance as that of surface 54 of those portions of rear panel 36 extending below panel 50 (those portions of rear panel 36 that are not concealed by panel 50 when panel 50 is in the concealment position). In the concealment position shown in FIGS. 1 and 2, surface 62 faces panel surface 54. In the example illustrated, panel 50 is retained in the concealment position with a retainer 64.

Retainer 64 retains panel 50 in the raised concealment position shown in FIG. 1. In one implementation, retainer 64 retains panel 50 and upwardly extending concealment position such that panel 50 cooperates with rear panel 36 to form a pocket or compartment for containing articles. In one implementation, retainer 64 comprises a zipper mechanism extending about opposite sides and a top edge of pocket 50. In another implementation, retainer 64 may comprise a hook and loop fastener system, wherein one of a hook and loop is secured to rear panel surface 54 and the other of the hook and loop is secured to surface 62 of panel 50. In yet another implementation, retainer 64 may comprise a hook or button formed on one of panel 36 and panel 50 which is removably receive a within a corresponding slit or loop formed on the other of panel 36 and panel 50.

The second surface 62 of panel 50 carries safety optics 52A. Safety optics 52 comprise surfaces that are visibly distinct from the appearance of surface 60 of panel 50 as well as those surfaces 54 of rear panel 36 which are not concealed by panel 50 when panel 50 is in the concealing position shown in FIG. 1. Safety optics 52 make the rear face of backpack 20 more visible to others in response to panel 50 being pivoted to the safety position shown in FIG. 3. As shown by FIG. 3, once pivoted to the safety position, surface 62 of panel 50 faces in the same direction as surface 54 of panel 36. At the same time, positioning of panel 50 in the safety position shown in FIGS. 3 and 4 further exposes safety optics 52B carried by surface 54 of rear panel 36.

In one implementation, each of safety optics 52 comprises a diffuse reflector. A diffuse reflector is a material or surface that reflects visible wavelength of light in a diffuse manner while absorbing less than 50% of the wavelengths of visible light. In some implementations, the diffuse reflector absorbs less than 5%, and nominally no wavelengths of visible light. A diffuse reflector may comprise material or surface that a light pigment, such as a material or surface having a white, gray, silver or tan color. In contrast to a dark color, such as black, brown or blue, the light pigment color reflects light from a trailing vehicle, allowing the person wearing the backpack to be more easily spotted and seen. In one implementation, the safety optic may comprise a diffuse reflector in the form of a shiny surface or a safety reflector in the form of an array of prisms or spheres, similar to those found in a bicycle reflector.

In one implementation, safety optics 52 each comprise a conspicuous color, a color that is more easily seen by the human eye as compared to other colors or the surrounding environment. Examples of the conspicuous color include yellow, yellow-green (sometimes called "lime yellow"), red, pink and orange. Blaze orange is an example of a conspicuous color.

In some implementations, safety optics 52 are each luminescent in that they emit light. For example, in one implementation, safety optics 52 may be fluorescent in the presence of visible light such as a yellow, orange or pink color that is fluorescent. In one implementation, the safety optic may be formed from a glow-in-the-dark material.

In one implementation, safety optics 52 may comprise a light emitter such as at least one light emitting diode or the light emission device 66. In one implementation, hinge 58 comprises a switch 68 that opens and closes in response to the positioning of panel 50 relative to panel 36 such that the light emitter or light-emitting diode is turned on and off response to pivoting of the safety panel of the backpack. For example, when panel 50 is in the concealment position shown in FIGS. 1 and 2, electrical power connection from a battery 70 to the light-emitting diodes 66 is broken such the light-emitting diodes are off. Movement of panel 50 to the safety position shown in FIGS. 3 and 4 results in the switch being closed, electrically connecting the source of power, the battery 70, to the light-emitting diodes 66, turning the light-emitting diodes on to emit light. In one implementation, light-emitting diodes (LEDs) are part of and are controlled by an integrated circuit such that the LEDs flash or change colors intermittently at a certain frequency. In some implementations, the battery 70 is rechargeable. In some imitations, the battery 70 is electrically connected to an external solar panel 72 formed on the exterior of backpack 20 which charges the battery 70. In other implementations, a separate pushbutton, toggle switch or slide bar may be used to turn light-emitting diodes 66 on and off independent of the positioning of panel 50. In some implementations, light-emitting diode 66 may alternatively or additionally be formed upon panel 50 as part of safety optic 52A. In some implementations, light-emitting diodes 66, battery 70 and/or solar panel 72 may be omitted.

In some implementations the safety optic that is exposed in response to pivoting of the safety panel comprises multiple optical safety elements. For example, in one implementation, pivoting of the safety panel 50 on the rear face of the backpack 20 may expose or make viewable, to persons trailing the person wearing the backpack, safety optics 52 that each comprise a diffuse optical reflector, a conspicuous color, a fluorescent color and/or a light emitting diode. In the example illustrated, safety optic 52B is illustrated as comprising both the light emitter in the form of LEDs 66 and a surface 74 that is either an optical diffuse reflector, fluorescent or a conspicuous color. In one implementation, safety optic 52A may comprise a first type of safety optics or safety optic 52B comprise a second distinct type of safety optic. For example, safety optic 52A may comprise a diffuse optical reflector while safety optic 52B comprises a conspicuous color. In one implementation, safety optic 52A may comprise a diffuse optical reflector while safety optic 52 comprises a light emitter.

As further shown by FIGS. 1, 3 and 4, backpack 20 additionally comprises an identification panel 76. Pivoting of the safety panel 50 to the safety position shown in FIGS. 3 and 4 exposes the panel 76. The identification panel 76 may include information identifying the person wearing the backpack or information associated with the person wearing the backpack. For example, the identification panel 76 may include address for a phone number for a parent or guardian of the child wearing the backpack. In the default inconspicuous state, safety panel conceals such personal information. However, in circumstances where a child is lost, pivoting of the panel allow the parent or guardian of the lost child to be identified in a crowd.

In some implementations, backpack 20 additionally comprises a safety position retainer 80. Retainer 80 secures and retains panel 50 in the conspicuous safety position shown in FIGS. 3 and 4. In one implementation, retainer 80 comprises one of a hook and loop system formed on rear panel 36 and the other of a hook and loop system formed on surface 60 of panel 50, wherein the hook and loop interlock when panel 50 is in the safety position. In another implementation, retainer 80 may comprise a hook or button coupled to one of panel 50 and panel 36 that is received within a loop or slit formed or carried by the other of panel 50 and panel 36. In some implementations, retainer 80 may be omitted.

Figure 6:
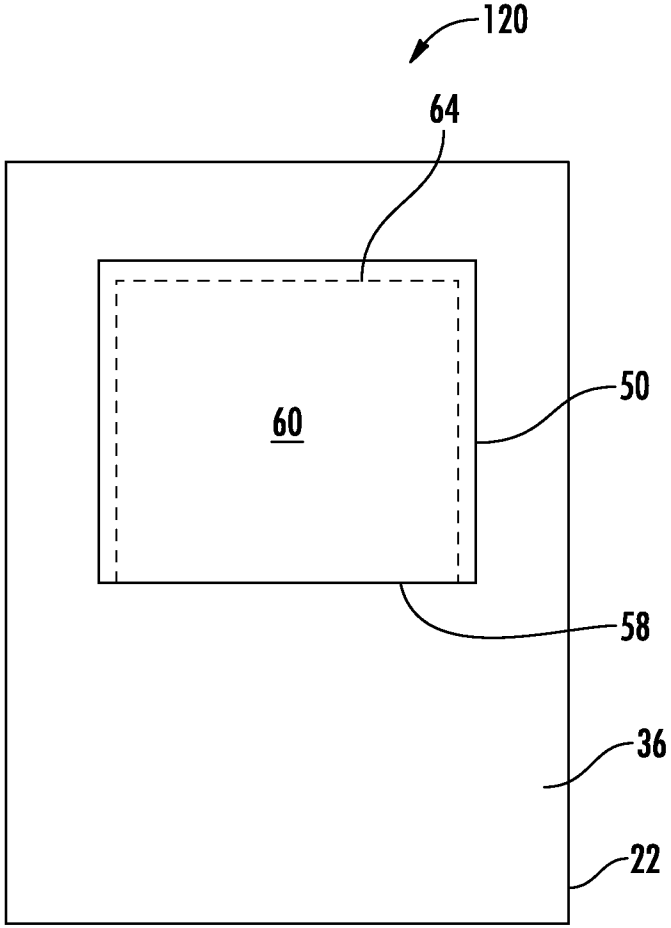
FIG. 6 is a rear view of the backpack of FIG. 5.
Figure 5:
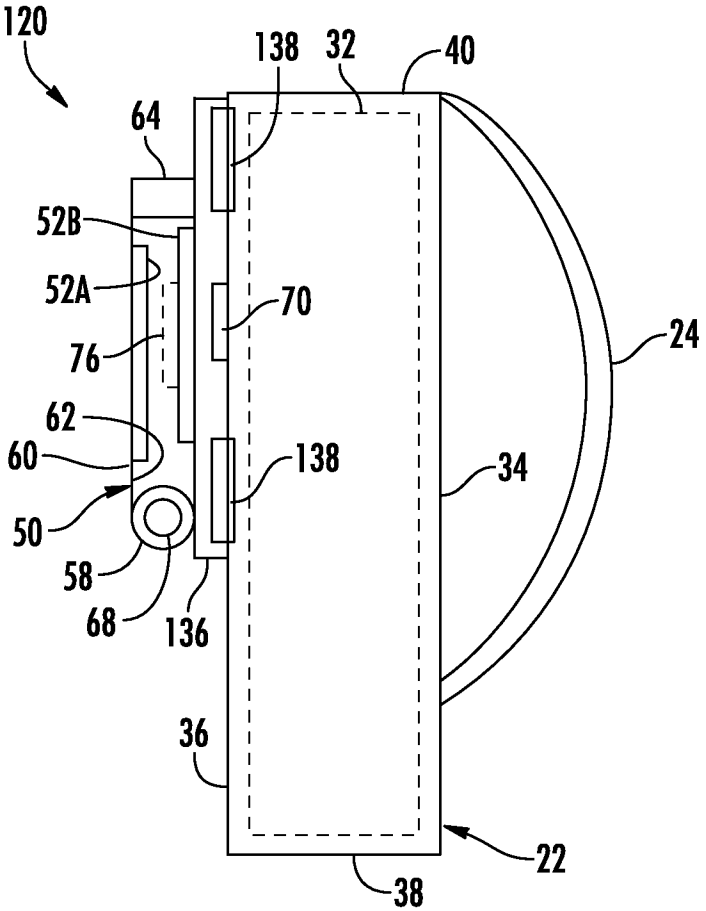
FIG. 5 is a sectional view schematically illustrating portions of an example backpack in an inconspicuous state.
Figure 8:
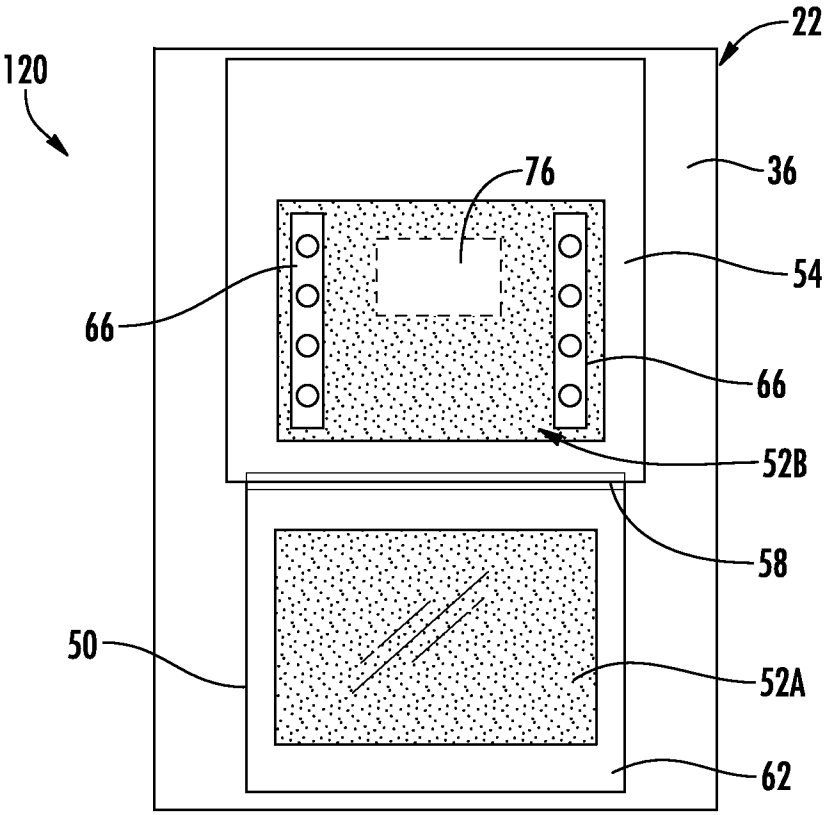
FIG. 8 is a rear view of the backpack of FIG. 7.
Figure 7:
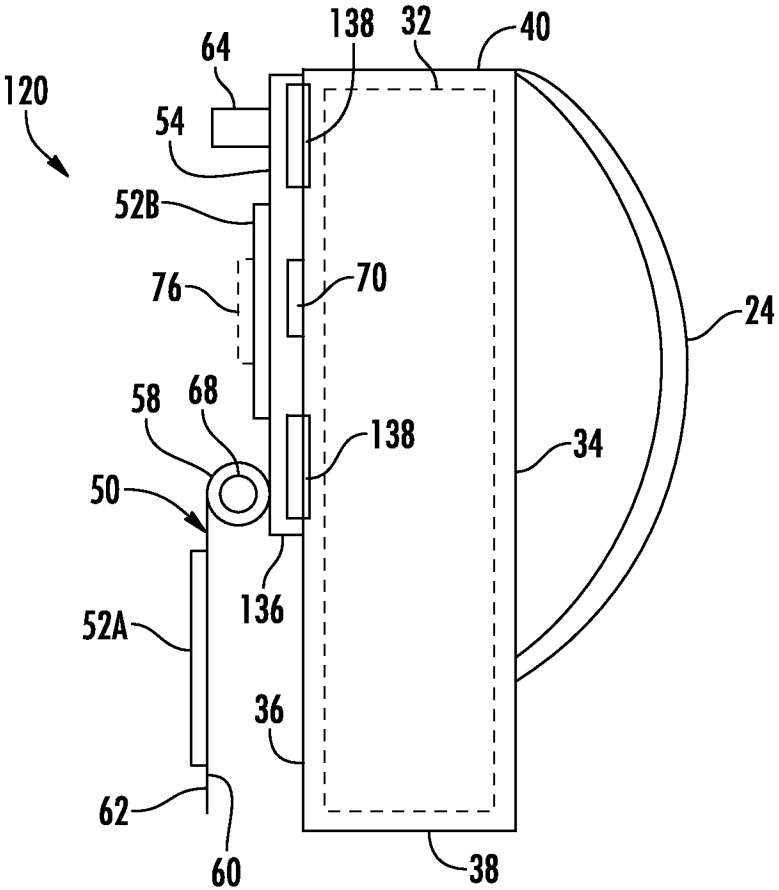
FIG. 7 is a sectional view schematically illustrating portions of the example backpack of FIG. 5 in a conspicuous safety state.

FIGS. 5-8 illustrate portions of another example backpack 120 that is actuatable between an inconspicuous state and a conspicuous safety state. FIGS. 5 and 6 illustrate backpack 120 in the inconspicuous state while FIGS. 7 and 8 illustrate backpack 120 in the conspicuous safety state. FIGS. 5 and 7 are side sectional views of backpack 120 while FIGS. 6 and 8 are rear views of backpack 120, the front of backpack 120 to face the person wearing backpack 120. Backpack 120 is similar to backpack 120 except that backpack 120 comprises backpack safety system 130 in place of backpack safety system 30. Backpack safety system 130 is itself similar to system 30 except that safety system 130 additionally comprises a base panel 136 which is removably mounted to rear panel 36 by system mounts 138.

In one implementation, system mounts 138 comprise a hook and loop fastener system. In one implementation, the hook and loop fastener system comprise one of a hook and loop formed to a front face of panel 136 and the other of the hook and loop formed upon rear panel 36. Those remaining components of system 130 which correspond to components of system 30 are numbered similarly and are supported as a unit by panel 136. System 130 facilitates the adaptation of existing backpacks to additionally include backpack safety system 130. System 130 further facilitates its removal per a user's preference.

Figure 10:
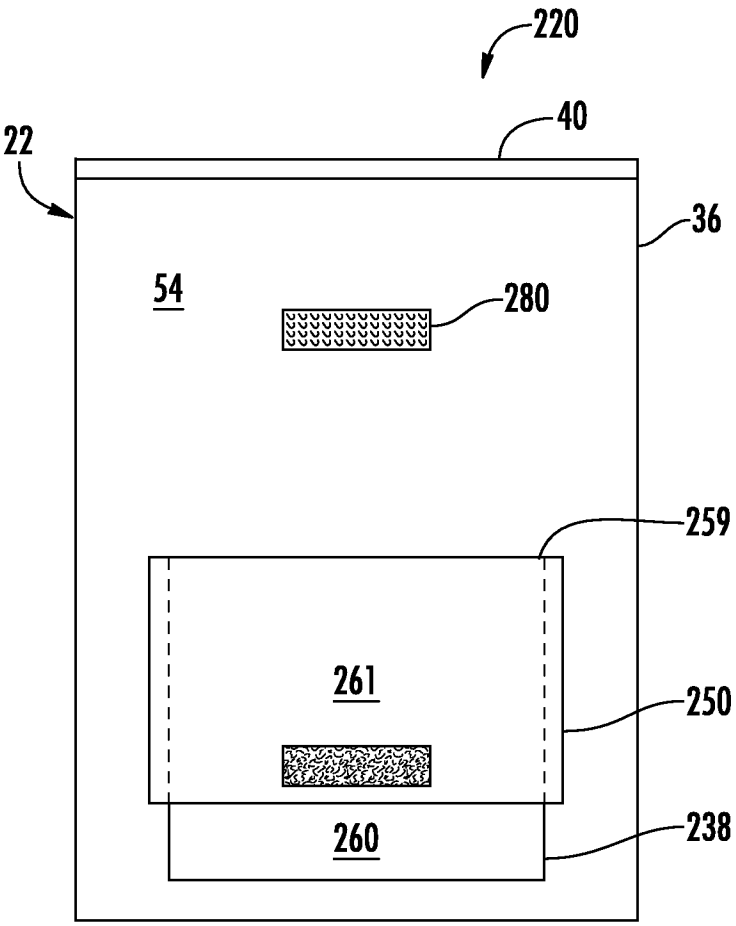
FIG. 10 is a rear view of the backpack of FIG. 9.
Figure 9:
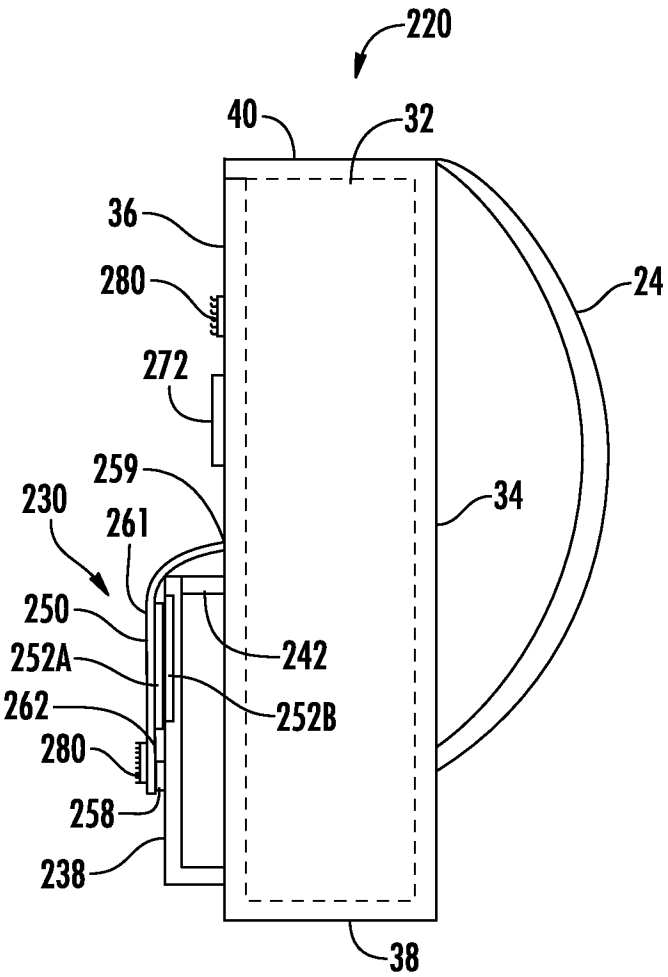
FIG. 9 is a sectional view schematically illustrating portions of an example backpack in an inconspicuous state.
Figure 12:
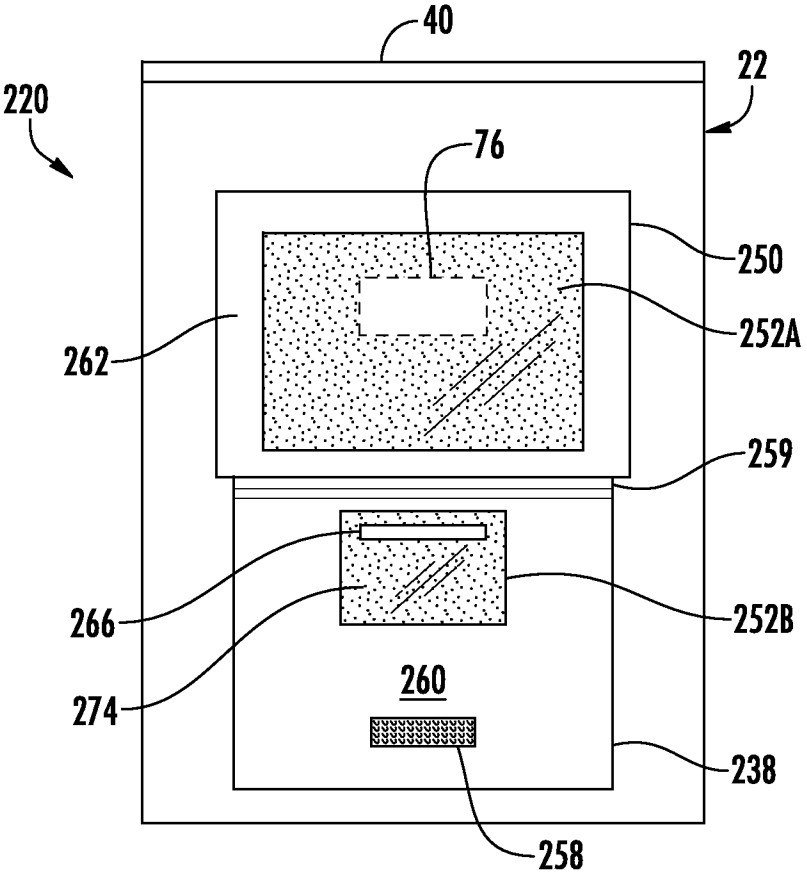
FIG. 12 is a rear view of the backpack of FIG. 11.
Figure 11:
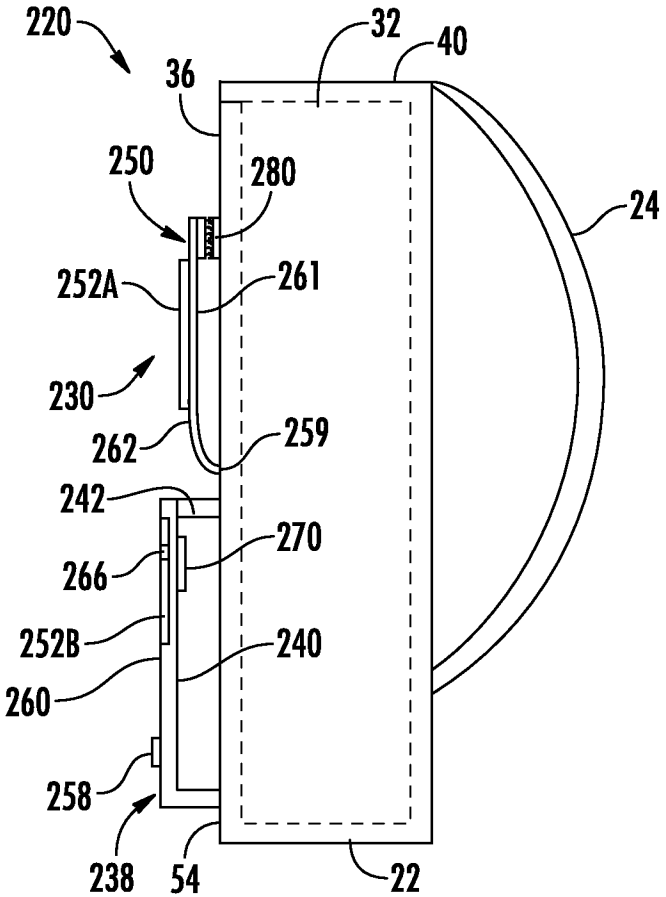
FIG. 11 is a sectional view schematically illustrating portions of the example backpack of FIG. 9 in a conspicuous safety state.

FIGS. 9-12 illustrate portions of another example backpack 220 that is actuatable between an inconspicuous state and a conspicuous safety state. FIGS. 9 and 10 illustrate backpack 220 in the inconspicuous state while FIGS. 11 and 12 illustrate backpack 220 in the conspicuous safety state. FIGS. 9 and 11 are side sectional views of backpack 220 while FIGS. 10 and 12 are rear views of backpack 220, the front of backpack 220 to face the person wearing backpack 220. Backpack 220 is similar to backpack 20 described above except that backpack 220 comprises backpack safety system 230 in place of backpack safety system 30. Those remaining components of backpack 220 which correspond to components of backpack 20 are numbered similarly.

Backpack safety system 230 comprises panel 238, panel 250 and safety optics 252A, 252B (collectively referred to as safety optics 252). Panel 238 extends from surface 54 of rear panel 36 and cooperates with rear panel 36 to form a pocket 240 along surface 54. Pocket 240 has a top opening 242 through which the interior of compartment 240 may be accessed. Panel 238 has a rear surface 260 supporting safety optic 252B.

Panel 250 comprise a flexible panel pivotably connected to panel 36 by hinge 259 above opening 242 of pocket 240. Panel 250 is pivotable between the pocket closing position shown in FIGS. 9 and 10 and the safety position shown in FIGS. 11 and 12. In the example illustrated, hinge 259 comprise a living hinge, providing pivot axis formed by the natural bending of the material forming panel 250. As shown by FIG. 9, panel 250 extends from hinge 259, over and across opening 242 while bending so as to extend rearwardly of panel 238, overlapping rear facing surface 259 of panel 238. Panel 250 forms a cover flap closing top opening 242 of pocket 240.

Panel 250 comprises surfaces 261 and 262. Surface 261 faces in a rearward direction away from body 22 when panel 250 is in the pocket closing position shown in FIGS. 9 and 10. Surface 262 is generally inconspicuous, not including a safety optic. For example, in one implementation, surface 262 may be a dark inconspicuous color, such as brown, blue or black colors. In one implementation, surface 262 is indistinct with respect to surface 54 of rear panel 36; surface 262 may have the same color and appearance as surface 54 of rear panel 36. In one implementation, surface 262 is provided by the same material as that providing resurface 54 of rear panel 36. As a result, when panel 250 is in the pocket closing position, panel 250 does not draw attention to the person wearing backpack 220.

Surface 262 extends opposite surface 261. Surface 262 faces pocket 240 when panel 250 is in the pocket closing position. Surface 262 carries and supports safety optic 252A.

As shown by FIG. 9, panel 250 is retained in place, in the pocket closing position with the retainer 258. In one implementation, retainer 258 comprise a hook and loop fastener arrangement, with one of a hook and loop formed on surface 260 of panel 238 and the other of the hook and loop formed on surface 262 of panel 250. The hooks and loops interact with one another to retain panel 250 in the closed state or position shown in FIG. 9. In other implementations, retainer 258 may comprise other mechanisms such as a hook or button received within a loop or slit, a clasp, or a side release buckle. In some implementations, retainer 258 may be omitted.

As shown by FIG. 11, safety panel 250 is releasably or removably retained in the safety position with a retainer 280. In one implementation, retainer 280 comprises one of a hook and loop system formed on rear panel 36 and the other of a hook and loop system formed on surface 261 of panel 250, wherein the hook and loop interlock when panel 250 is in the safety position. In another implementation, retainer 280 may comprise a hook or button coupled to one of panel 250 and panel 36 that is received within a loop or slit formed or carried by the other of panel 250 and panel 36. In yet other implementations, retainer 280 may comprise a side release buckle mechanism.

Safety optics 52 comprise surfaces that are visibly distinct from the appearance of surface 260 of panel 238 as well as those surfaces 54 of rear panel 36. Safety optics 252 make the rear face of backpack 220 more visible to others in response to panel 250 being pivoted to the safety position shown in FIGS. 11 and 12. As shown by FIG. 11, once pivoted to the safety position, surface 262 of panel 250 faces in the same direction as surface 54 of panel 36 and in the same direction as surface 260 of panel 238. At the same time, positioning of panel 250 in the safety position shown in FIGS. 11 and 12 further exposes safety optics 252B carried by surface 260 of panel 238.

In one implementation, safety optics 252 each comprises a diffuse reflector. A diffuse reflector is a material or surface that reflects visible wavelength of light in a diffuse manner while absorbing less than 50% of the wavelengths of visible light. In some implementations, the diffuse reflector absorbs less than 5%, and nominally no wavelengths of visible light. A diffuse reflector may comprise material or surface that a light pigment, such as a material or surface having a white, gray, silver or tan color. In contrast to a dark color, such as black, brown or blue, the light pigment color reflects light from a trailing vehicle, allowing the person wearing the backpack to be more easily spotted and seen. In one implementation, the safety optic may comprise a diffuse reflector in the form of a shiny surface or a safety reflector in the form of an array of prisms or spheres, similar to those found in a bicycle reflector.

In one implementation, each of safety optics 252 comprise a conspicuous color, a color that is more easily seen by the human eye as compared to other colors or the surrounding environment. Examples of the conspicuous color include yellow, yellow-green (sometimes called "lime yellow"), red, pink and orange. Blaze orange is an example of a conspicuous color.

In some implementations, safety optics 252 are each luminescent in that they emit light. For example, in one implementation, safety optics 252 may be fluorescent in the presence of visible light such as a yellow, orange or pink color that is fluorescent. In one implementation, the safety optic may be formed from a glow-in-the-dark material.

In one implementation, safety optics 252 may comprise a light emitter such as at least one light emitting diode or the light emission device 266. In one implementation, hinge 259 comprises a switch 68 (shown and described above with respect to FIG. 1) that opens and closes in response to the positioning of panel 250 in the safety position such that the light emitter or light-emitting diode is turned on and off response to pivoting of the safety panel of the backpack. For example, when panel 250 is in the pocket closing position shown in FIGS. 9 and 10, electrical power connection from a battery 270 to the light-emitting diodes 266 is broken such the light-emitting diodes are off. Movement of panel 250 to the safety position shown in FIGS. 11 and 12 results in the switch being closed, electrically connecting the source of power, the battery 270, to the light-emitting diodes 266, turning the light-emitting diodes on to emit light. In one implementation, light-emitting diodes are part of and controlled by an integrated circuit such that the LEDs flash or change colors intermittently at a certain frequency. In some implementations, the battery 270 is rechargeable. In some imitations, the battery 270 is electrically connected to an external solar panel 272 formed on the exterior of backpack 220 which charges the battery 270. In other implementations, a separate pushbutton, toggle switch or slide bar may be used to turn light-emitting diodes 266 on and off independent of the positioning of panel 250. In some implementations, light-emitting diode 266 may alternatively or additionally be formed upon panel 250 as part of safety optic 252A. In some implementations, light-emitting diodes 266, battery 270 and/or solar panel 272 may be omitted.

In some implementations the safety optic that is exposed in response to pivoting of the safety panel comprises multiple optical safety elements. For example, in one implementation, pivoting of the safety panel 250 on the rear face of the backpack 220 may expose or make viewable, to persons trailing the person wearing the backpack, safety optics 252 that each comprise a diffuse optical reflector, a conspicuous color, a fluorescent color and/or a light emitting diode. In the example illustrated, safety optic 252B is illustrated as comprising both the light emitter in the form of LEDs 266 and a surface 274 that is either an optical diffuse reflector, fluorescent or a conspicuous color. In one implementation, safety optic 252A may comprise a first type of safety optics or safety optic 252B comprise a second distinct type of safety optic. For example, safety optic 252A may comprise a diffuse optical reflector while safety optic 252B comprises a conspicuous color. In one implementation, safety optic 252A may comprise a diffuse optical reflector while safety optic 252 comprises a light emitter.

As further shown by FIG. 12, backpack 220 may additionally comprise an identification panel 76. Pivoting of the safety panel 50 to the safety position shown in FIGS. 11 and 12 exposes the panel 76. The identification panel 76 may include information identifying the person wearing the backpack or information associated with the person wearing the backpack. For example, the identification panel 76 may include address for a phone number for a parent or guardian of the child wearing the backpack. In the default inconspicuous state, safety panel conceals such personal information. However, in circumstances where a child is lost, pivoting of the panel allow the parent or guardian of the lost child to be identified.

Figure 14:
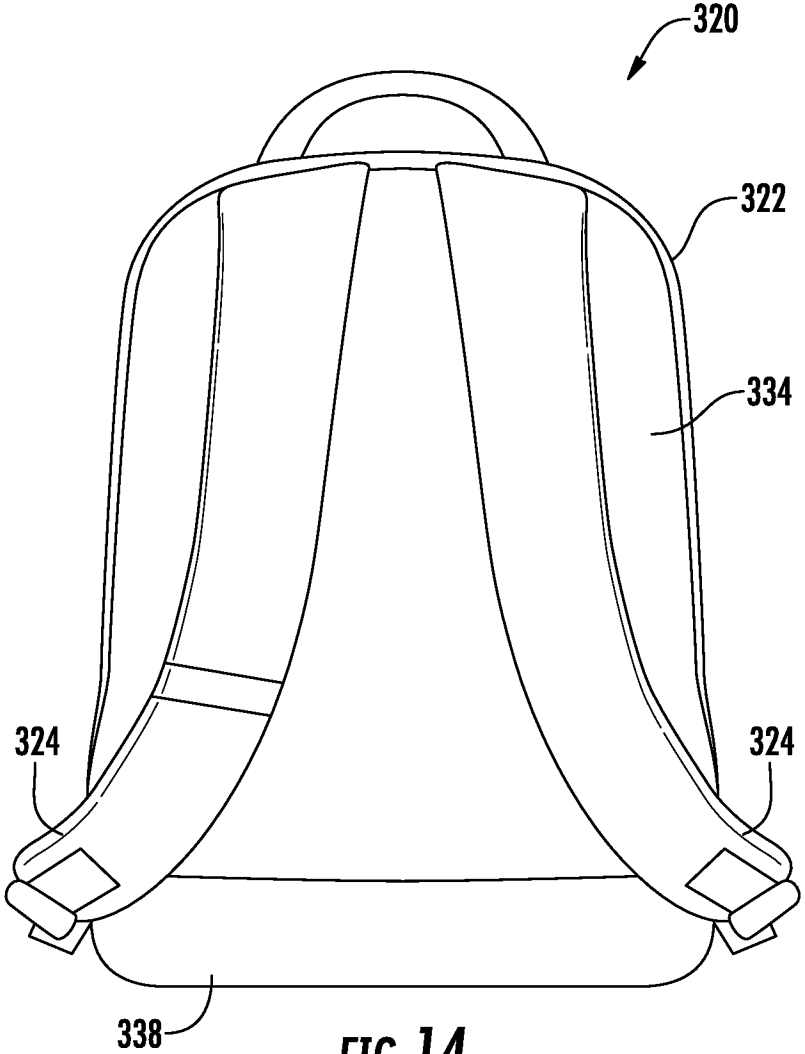
FIG. 14 is a front view of the example backpack of FIG. 13.
Figure 13:
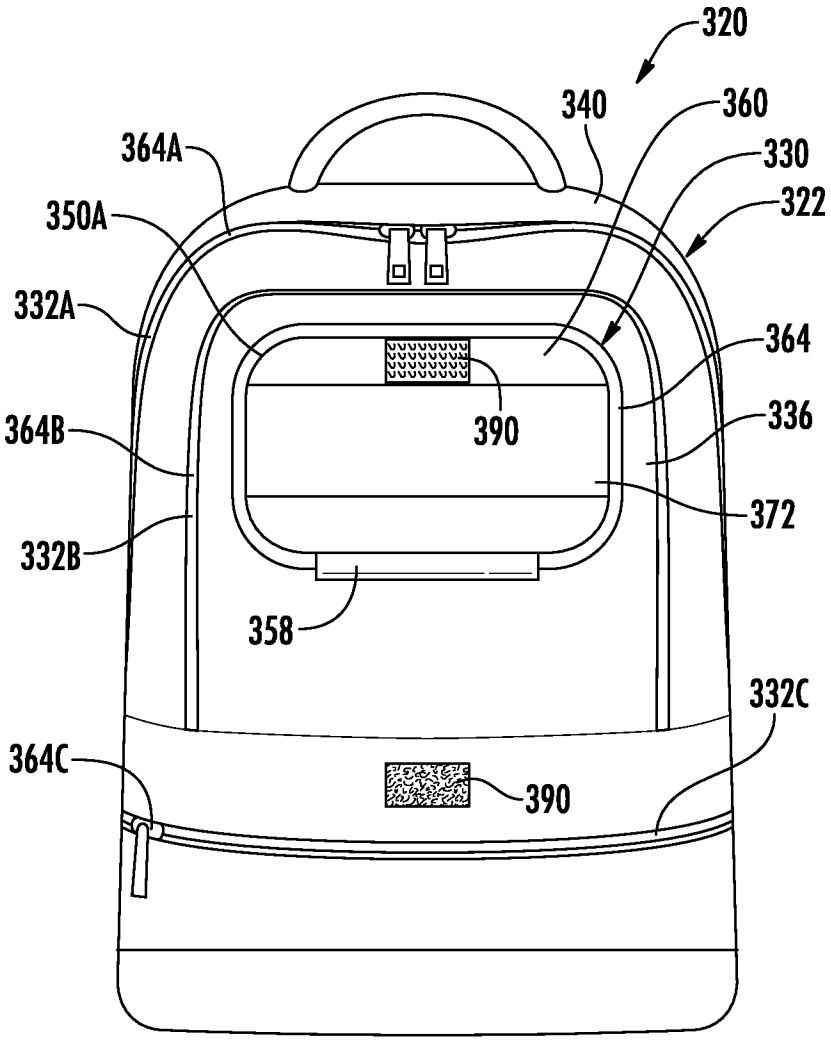
FIG. 13 is a rear view of an example backpack in an inconspicuous state.

FIGS. 13 and 14 illustrate portions of an example backpack 320. FIG. 13 is a rear view of backpack 320 while FIG. 14 is a front view of backpack 320. As with the above described backpacks, backpack 320 is actuatable between an inconspicuous state and a conspicuous safety state. FIGS. 13 and 14 illustrate backpack 320 in the inconspicuous state. Backpack 320 comprises main body 322, shoulder straps 324 and backpack safety system 330.

Main body 322 comprises an arrangement of panels that form an interior compartment. In some implementations, main body 322 forms a main compartment 332A accessible through an opening closed by zipper 364A, a rear compartment 332B accessible through an opening closed by zipper 364B and a lower pocket or compartment 332C accessible through an opening closed by zipper 364C. In one implementation, main body 322 comprises a front panel 334, rear panel 336, which forms a rear of compartment 364B, a bottom panel 338 and a top panel, such as a cover panel 340. Panels 334, 336, 338 and 340 may be formed from fabric, vinyl, canvas or variety of different materials. Panels 334, 336, 338 and 340 may be sewn or stitched to one another so as to form compartments 332.

Shoulder straps 324 extend from body 322 along front panel 334. Shoulder straps 324 have a length so as to wrap about the shoulders of a person wearing backpack 320. In one implementation, shoulder straps 324 each have an adjustable length. In some implementations, backpack 320 may omit one of shoulder straps 324. In some implementations, backpack 320 may additionally comprise a hip belt or waist harness (not shown) projecting the sides and/or front panel 334, the hip belt to wrap about the waste and hips of a person wearing backpack 320.

Figure 16:
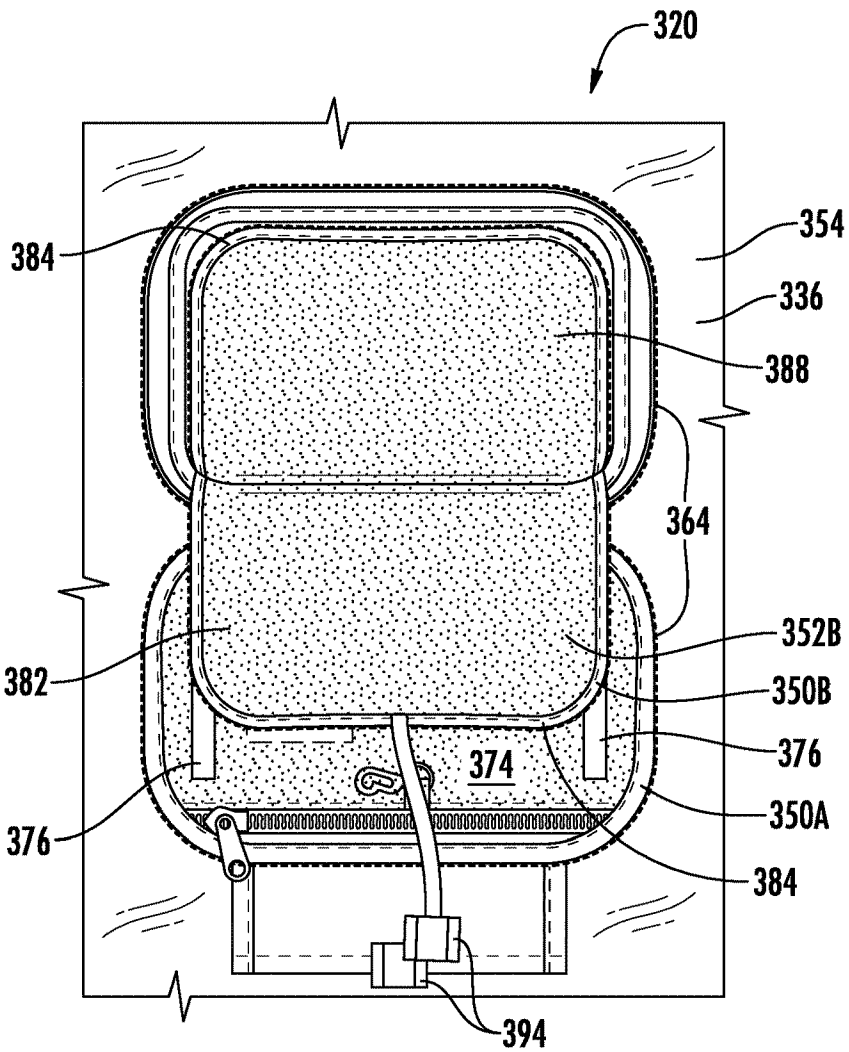
FIG. 16 is an enlarged view of the backpack safety system of FIG. 13 in a second safety state.
Figure 15:
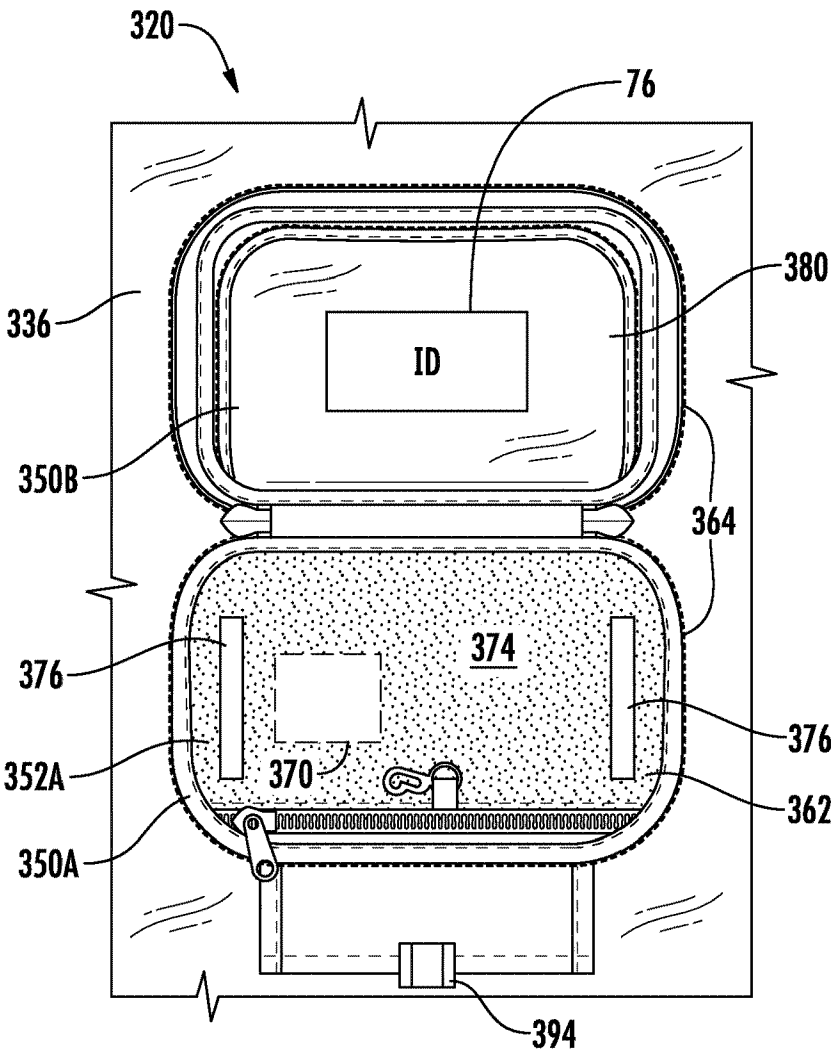
FIG. 15 is an enlarged view of a backpack safety system of the backpack of FIG. 13 in a first safety state.

Backpack safety system 330 converts backpack 320 to a conspicuous safety state such that the person wearing backpack 320 may be more easily seen and/or identified. FIGS. 15 and 16 illustrate backpack safety system 330 in more detail. FIG. 15 illustrates backpack 320 in a first safety state while FIG. 16 illustrates backpack 320 partially moved towards a second different safety state. System 330 comprises rear panel 336, safety panel 350A, safety panel 350B and safety optics 352A, 352B (collectively referred to as safety optics 352). Rear panel 336 comprises a panel having a rearwardly facing panel surface 354. Surface 354 faces away from the person wearing backpack 320. In the example illustrated, rear panel 336 forms a part of or defines compartment 332B. In the example illustrated rear panel 36 is integrally formed as a single unitary body as part of body 322, inseparable from pack 320.

Safety panel 350A is pivotably coupled to rear panel 336 for pivotal movement between a concealment position shown in FIG. 13 and a safety position shown in FIG. 15. In the example illustrated, safety panel 350A is pivotably coupled to rear panel 336 for pivotal movement about a hinge 358. In the example illustrated, hinge 358 comprises a living hinge, a hinge formed by the flexibility and bendability of the material adjacent a juncture of the end portion of panel 350A and panel 336. For example, in one implementation, panel 350A may be formed from a flexible fabric material stitched, welded or adhered to rear panel 336, wherein the flexible fabric material is bendable, allowing panel 350A to bend or pivot to the position shown in FIG. 15. In one implementation, panel 350A may be coupled to rear panel 336, wherein panel 350A is pivotable about a fold or series of perforations within or through portions of panel 350A.

As shown by FIG. 13, panel 350A has an exterior rearwardly facing first surface 360. In the example illustrated, surface 360 is inconspicuous does not include safety optics 352. In the concealment position shown in FIG. 13, surface 360 faces in the same direction as panel surface 354 of rear panel 336. In one implementation, surface 360 has a same appearance as that of surface 354 of those portions of rear panel 336 extending below panel 350 (those portions of rear panel 336 that are not concealed by panel 350A when panel 350A is in the concealment position).

As shown by FIG. 15, panel 350A has a second surface 362. In the concealment position shown in FIG. 13, surface 362 faces panel surface 354. In the safety position shown in FIG. 15, surface 362 faces away from surface 354, extending generally parallel to surface 354. Surface 362 supports safety optics 352A such as safety optics 352A are concealed when panel 350A is in the concealment position in FIG. 13 and are exposed, facing rearwardly in the first safety position shown in FIG. 15.

As further shown by FIG. 15, backpack 320 additionally comprises an identification panel 76. Identification panel 76 is formed on surface 380 of safety panel 350B. Pivoting of the safety panel 350A to the safety position shown in FIG. 15 exposes the panel 76. The identification panel 76 may include information identifying the person wearing the backpack or information associated with the person wearing the backpack. For example, the identification panel 76 may include address for a phone number for a parent or guardian of the child wearing the backpack. In the default inconspicuous state, safety panel conceals such personal information. However, in circumstances where a child is lost, pivoting of the panel allow the parent or guardian of the lost child to be identified.

In the example illustrated, panel 350A is retained in the concealment position with a retainer 364. Retainer 364 retains panel 350A in the raised concealment position shown in FIG. 13. In one implementation, retainer 364 retains panel 350A in an upwardly extending concealment position such that panel 350A cooperates with rear panel 336 (and panel 350B) to form a pocket or compartment for containing articles. In one implementation, retainer 364 comprises a zipper mechanism extending about opposite sides and a top edge of pocket 350A. In another implementation, retainer 364 may comprise a hook and loop fastener system, wherein one of a hook and loop is secured to rear panel surface 354 and the other of the hook and loop is secured to surface 362 of panel 350A. In yet another implementation, retainer 364 may comprise a hook or button formed on one of panel 336 and panel 350A which is removably receive a within a corresponding slit or loop formed on the other of panel 336 and panel 350A.

The second surface 362 of panel 350A carries safety optics 352A. Safety optics 352A comprise surfaces that are visibly distinct from the appearance of surface 360 of panel 350 as well as those surfaces 354 of rear panel 336 which are not concealed by panel 350A when panel 350A is in the concealment position shown in FIG. 13. Safety optics 352A make the rear face of backpack 320 more visible to others in response to panel 350A being pivoted to the safety position shown in FIG. 15. As shown by FIG. 15, once pivoted to the safety position, surface 362 of panel 350A faces in the same direction as surface 354 of panel 336.

Safety panel 350B is pivotably coupled to rear panel 336 and is sandwiched between rear panel 336 and safety panel 350A. Safety panel 350B has a first surface 380 supporting identification panel 376 and a second surface 382 which supports safety optic 352B. Safety panel 350B pivots between a concealment position shown in FIG. 15 in which safety panel 350B conceals safety optic 352B and a safety position shown in FIG. 16 in which safety panel 350B exposes safety optic 3526, extending parallel to rear panel 336 as well as safety panel 350A. When fully moved to the second safety position, safety panel 350B conceals a majority, if not all of safety optic 352A.

Safety panel 350B is retained in the concealment position with a retainer 384. Retainer 384 retains panel 350B in the raised concealment position shown in FIG. 15. In one implementation, retainer 384 retains panel 350B in an upwardly extending concealment position such that panel 350B cooperates with rear panel 336 to form a pocket or compartment for containing articles. In one implementation, retainer 384 comprises a zipper mechanism extending about a perimeter of panel 350B and along rear panel 336, inward of retainer 364 and the outer perimeter of panel 350A. In another implementation, retainer 384 may comprise a hook and loop fastener system, wherein one of a hook and loop is secured to rear panel surface 354 and the other of the hook and loop is secured to surface 382 of panel 350B. In yet another implementation, retainer 384 may comprise a hook or button formed on one of panel 336 and panel 350B which is removably receive a within a corresponding slit or loop formed on the other of panel 336 and panel 350B.

In the example illustrated, safety optics 352A comprises a diffuse reflector 374 and light emitters 376. A diffuse reflector is a material or surface that reflects visible wavelength of light in a diffuse manner while absorbing less than 50% of the wavelengths of visible light. In some implementations, the diffuse reflector absorbs less than 5%, and nominally no wavelengths of visible light. A diffuse reflector may comprise material or surface that a light pigment, such as a material or surface having a white, gray, silver or tan color. In contrast to a dark color, such as black, brown or blue, the light pigment color reflects light from a trailing vehicle, allowing the person wearing the backpack to be more easily spotted and seen. In one implementation, the safety optic may comprise a diffuse reflector in the form of a shiny surface or a safety reflector in the form of an array of prisms or spheres, similar to those found in a bicycle reflector.

In one implementation, light emitters 376 each at least one light emitting diode. In one implementation, hinge 358 comprises a switch 68 (shown and described above with respect to backpack 20) that opens and closes in response to the positioning of panel 350A relative to panel 336 such that the light emitter or light-emitting diode is turned on and off response to pivoting of the safety panel of the backpack. For example, when panel 350A is in the concealment position shown in FIG. 13, electrical power connection from a battery 370 (embedded within panel 350A) to the light-emitting diodes a light emitter 376 is broken such the light-emitting diodes are off. Movement of panel 350A to the safety position shown in FIG. 15 results in the switch being closed, electrically connecting the source of power, the battery 370, to the light-emitting diodes of light emitter 376, turning the light-emitting diodes on to emit light. In one implementation, light-emitting diodes form part of and are controlled by an integrated circuit such that the LEDs flash or change colors intermittently at a certain frequency. In some implementations, the battery 370 is rechargeable. In some imitations, the battery 370 is electrically connected to an external solar panel 372 formed on the exterior of backpack 320 which charges the battery 370. In other implementations, a separate pushbutton, toggle switch or slide bar may be used to turn light-emitting diodes of light emitter 376 on and off independent of the positioning of panel 350A. In some implementations, light-emitting diodes of light emitters 376, battery 370 and/or solar panel 372 may be omitted.

In the example illustrated, safety optic 352B comprise a conspicuous color, a color that is more easily seen by the human eye as compared to other colors or the surrounding environment. Examples of the conspicuous color include yellow, yellow-green (sometimes called "lime yellow"), red, pink and orange. Blaze orange is an example of a conspicuous color. As shown by FIG. 16, safety optic 352B additionally extends upon surface 388 of rear panel 336.

In other implementations, one or both of optics 352 may be luminescent in that they emit light. For example, in one implementation, safety optics 352 may be fluorescent in the presence of visible light such as a yellow, orange or pink color that is fluorescent. In one implementation, the safety optic may be formed from a glow-in-the-dark material.

In some implementations the safety optic 352A, 352B that is exposed in response to pivoting of the safety panel comprises multiple optical safety elements. For example, in one implementation, pivoting of the safety panel 350A or 350B on the rear face of the backpack 320 may expose or make viewable, to persons trailing the person wearing the backpack, safety optics 352 that each comprise a diffuse optical reflector, a conspicuous color, a fluorescent color and/or a light emitting diode.

As shown by FIGS. 15 and 16, safety panel 350A and 350B facilitates actuation of backpack 320 between different safety states such that backpack 320 may provide safety in different conditions. For example, in lowlight situations or at night, backpack 320 may be actuated to the first safety state shown in FIG. 15. In normal daylight hours, but where backpack 320 is to be visibly distinct from the surrounding environment, such as foliage or other individuals in a crowd, backpack 320 may be actuated to the second safety state shown in FIG. 16. As a result, backpack 320 provides enhanced adaptability two different uses and environments.

In some implementations, backpack 320 additionally comprises a safety position retainer 390. Retainer 390 secures and retains panel 350A in the conspicuous safety position shown in FIGS. 15 and 16. In one implementation, retainer 390 comprises one of a hook and loop system formed on rear panel 336 and the other of a hook and loop system formed on surface 360 of panel 350A, wherein the hook and loop interlock when panel 350A is in the safety position. In another implementation, retainer 390 may comprise a hook or button coupled to one of panel 350A and panel 336 that is received within a loop or slit formed or carried by the other of panel 350A and panel 336. In some implementations, retainer 390 may be omitted.

In the example illustrated, backpack 320 additionally comprises a safety position retainer 394. Retainer 394 secures and retains panel 350B in the conspicuous safety position shown in FIG. 16. In one implementation, retainer 394 comprises a first portion of a quick release buckle are side release buckle tethered to panel 350B and a second portion secured to rear panel 336. In other implementations, retainer 394 may comprise other mechanisms for releasably retaining panel 350B in the safety position. For example, in lieu of the side release buckle, retainer 394 may comprise a hook and loop fastener, a snap, a hook and corresponding ring or a button and corresponding slit. In some implementations, retainer 394 may be omitted.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A backpack comprising:

a first panel having a first panel surface facing in a direction;

a second panel having a second panel first surface and a second panel second surface opposite the second panel first surface, wherein the second panel first surface is inconspicuous and wherein the second panel is pivotable relative to the first panel between (1) a concealment position in which second panel second surface faces the first panel surface and (2) a safety position in which the second panel second surface faces in the direction; and a safety optic formed on one of the first panel surface and the second panel second surface;

a third panel having a third panel surface facing in the direction; and a second safety optic different than the safety optic, wherein the first panel further comprises a first panel second surface, wherein the first panel is pivotable relative to the third panel between a retained position in which the first panel second surface faces the third panel surface and an extended position in which the first panel second surface faces in the direction, and wherein the second safety optic is formed on at least one of the third panel surface and the first panel second surface.

2. The backpack of claim 1, wherein the safety optic comprises a light emitter, the light emitter actuated between an on state and an off state in response to pivoting of the second panel, the light emitter being actuated to the on state in response to pivoting of the second panel to the safety position.

3. The backpack of claim bracket 1, wherein the second panel second surface and the first panel surface extend in parallel planes when the second panel is in the safety position.

4. The backpack of claim bracket 1, wherein the second panel second surface hangs below the first panel surface when the second panel is in the safety position.

5. The backpack of claim 1, further comprising a retainer to retain the second panel in the safety position.

6. The backpack of claim 5, wherein the retainer comprises a hook and loop fastener.

7. The backpack of claim 1 further comprising a zipper mechanism about a perimeter of the second panel to retain the second panel in the concealment position.

8. The backpack of claim 1 further comprising an identification panel formed on the second panel second surface, wherein the safety optic is formed on the first panel surface.

9. The backpack of claim 1, wherein the safety optic comprises a diffuse reflector and wherein the second safety optic comprises a conspicuous color.

10. The backpack of claim 1, wherein the first panel is sandwiched between the second panel and the third panel when the second panel is in the concealment position.

11. The backpack of claim 1 further comprising:

a first zipper mechanism about a perimeter of the second panel to retain the second panel in the concealment position; and a second zipper mechanism about a perimeter of the first panel and peripherally inside of the perimeter of the second panel, the second zipper mechanism to retain the first panel in the retained position.

12. The backpack of claim 1 further comprising an identification panel formed on the first panel surface and facing in the direction, wherein the safety optic is formed on the second panel second surface.

13. The backpack of claim 1 further comprising an identification panel formed on one of the third panel surface and the first panel second surface.

14. The backpack of claim 1, wherein the first panel forms a chamber between the first panel surface and the second panel second surface when the second panel is in the concealment position.

15. The backpack of claim 1, wherein the safety optic comprises a diffuse reflector covering a majority of said one of the first panel surface and the second panel second surface.

16. The backpack of claim 1, wherein the safety optic comprises a conspicuous color comprising yellow and orange.

17. The backpack of claim 1, wherein the second panel forms a pocket between the first panel and the second panel when the second panel is in the concealment position and wherein the pocket is eliminated when the second panel is in the safety position.

18. A backpack comprising:

a first panel having a first panel surface facing in a direction;

a second panel having a second panel first surface and a second panel second surface opposite the second panel first surface, wherein the second panel first surface is inconspicuous and wherein the second panel is pivotable relative to the first panel between (1) a concealment position in which second panel second surface faces the first panel surface to form a pocket and (2) a safety position in which the second panel second surface faces in the direction to eliminate the pocket;

a safety optic formed on one of the first panel surface and the second panel second surface, an identification panel including personal information identifying the person wearing the backpack or providing contact information for a parent or guardian of the person wearing the backpack, wherein the identification panel is formed on the first panel surface or the second panel surface such that the personal information is concealed in the pocket in response to the second panels being pivoted to the concealment position and such that the personal information and the safety optic are both exposed in response to the second panel being pivoted to the safety position;

a third panel having a third panel surface facing in the direction; and a second safety optic different than the safety optic, wherein the first panel further comprises a first panel second surface, wherein the first panel is pivotable relative to the third panel between a retained position in which the first panel second surface faces the third panel surface and an extended position in which the first panel second surface faces in the direction, and wherein the second safety optic is formed on at least one of the third panel surface and the first panel second surface.

* * * * *